United States Patent [19]

Kunin et al.

[11] Patent Number: 4,606,894

[45] Date of Patent: Aug. 19, 1986

[54] URANIUM RECOVERY FROM CARBONATE LEACH LIQUORS USING CARBOXYLIC ACID CATION EXCHANGE RESIN

[75] Inventors: Robert Kunin, Yardley, Pa.; Terrance LaTerra, Old Bridge, N.J.

[73] Assignee: Ecodyne Corporation, Union, N.J.

[21] Appl. No.: 524,223

[22] Filed: Aug. 19, 1983

Related U.S. Application Data

[63] Continuation of Ser. No. 190,992, Sep. 26, 1980, abandoned.

[51] Int. Cl.[4] ..... C22B 60/02

[52] U.S. Cl. ..... 423/7; 423/17; 423/DIG. 14; 210/682

[58] Field of Search ..... 423/6, 7, 17, DIG. 14; 210/682

[56] References Cited

U.S. PATENT DOCUMENTS

| | | | |
|---|---|---|---|
| 2,780,514 | 2/1957 | Lutz | 423/7 |
| 2,807,582 | 9/1957 | Applebaum | 210/664 |
| 2,811,412 | 10/1957 | Pairier | 423/7 |
| 2,841,468 | 7/1958 | Wilson | 423/7 |
| 2,849,282 | 8/1958 | Boyd | 423/7 |
| 2,864,667 | 12/1958 | Bailes et al. | 423/7 |
| 2,925,431 | 2/1960 | Choppin et al. | 423/7 |
| 2,982,605 | 5/1961 | Mouret et al. | 423/7 |
| 3,434,809 | 3/1969 | Swanson | 423/7 |
| 3,595,784 | 7/1971 | Butterworth | 210/343 |
| 3,639,231 | 2/1972 | Bresler | 210/638 |
| 3,800,023 | 3/1974 | Haas | 423/7 |
| 3,995,009 | 11/1976 | Notz | 423/7 |
| 4,092,399 | 5/1978 | Narayan et al. | 423/7 |
| 4,141,825 | 2/1979 | Conger | 204/182.3 |
| 4,155,982 | 5/1979 | Hunkin et al. | 423/7 |
| 4,161,447 | 7/1979 | Kojima | 210/639 |
| 4,176,057 | 11/1979 | Wheatley et al. | 210/637 |
| 4,233,272 | 11/1980 | Eresen et al. | 423/7 |
| 4,293,527 | 10/1981 | Morgan et al. | 210/682 |
| 4,303,620 | 12/1981 | Rendall et al. | 423/6 |

FOREIGN PATENT DOCUMENTS

| | | | |
|---|---|---|---|
| 476190 | 6/1973 | Australia . | |
| 524299 | 8/1979 | Australia . | |
| 0136129 | 10/1980 | Japan | 423/7 |
| WO79/00920 | 11/1979 | PCT Int'l Appl. . | |
| 812815 | 4/1959 | United Kingdom | 423/7 |
| 845842 | 8/1960 | United Kingdom | 423/7 |
| 894392 | 4/1962 | United Kingdom | 423/7 |
| 1381412 | 1/1975 | United Kingdom | 423/7 |
| 1469042 | 3/1977 | United Kingdom | 423/6 |
| 2001613A | 2/1979 | United Kingdom | 423/7 |
| 2039268A | 8/1980 | United Kingdom | 423/7 |

OTHER PUBLICATIONS

USAEC Report RM-2502, Declassified.

Kunin, Robert "Ion Exchange Resins" 1972, pp. 190–197.

Merritt, Robert C. "The Extractive Metallurgy of Uranium" 1971, pp. 137–182.

Kunin, Robert "Elements of Ion Exchange" 1971, pp. 102–109.

*Primary Examiner*—Deborah L. Kyle

*Assistant Examiner*—Matthew A. Thexton

*Attorney, Agent, or Firm*—Dressler, Goldsmith, Shore, Sutker & Milnamow, Ltd.

[57] ABSTRACT

A process and apparatus for recovering uranium from a carbonate solution containing uranium ions whereby the carbonate solution containing uranium ions is brought in contact with a cation exchanger so that a uranium cation is removed from solution and adsorbed by the cation exchanger, and the uranium cation is then removed from the cation exchanger. The treated carbonate solution from which uranium ions hve been removed by cation exchange is then further processed by removing carbon dioxide from the treated carbonate solution to produce a decarbonated solution, and passing the decarbonated solution through a membrane process to remove some remaining impurities.

12 Claims, 1 Drawing Figure

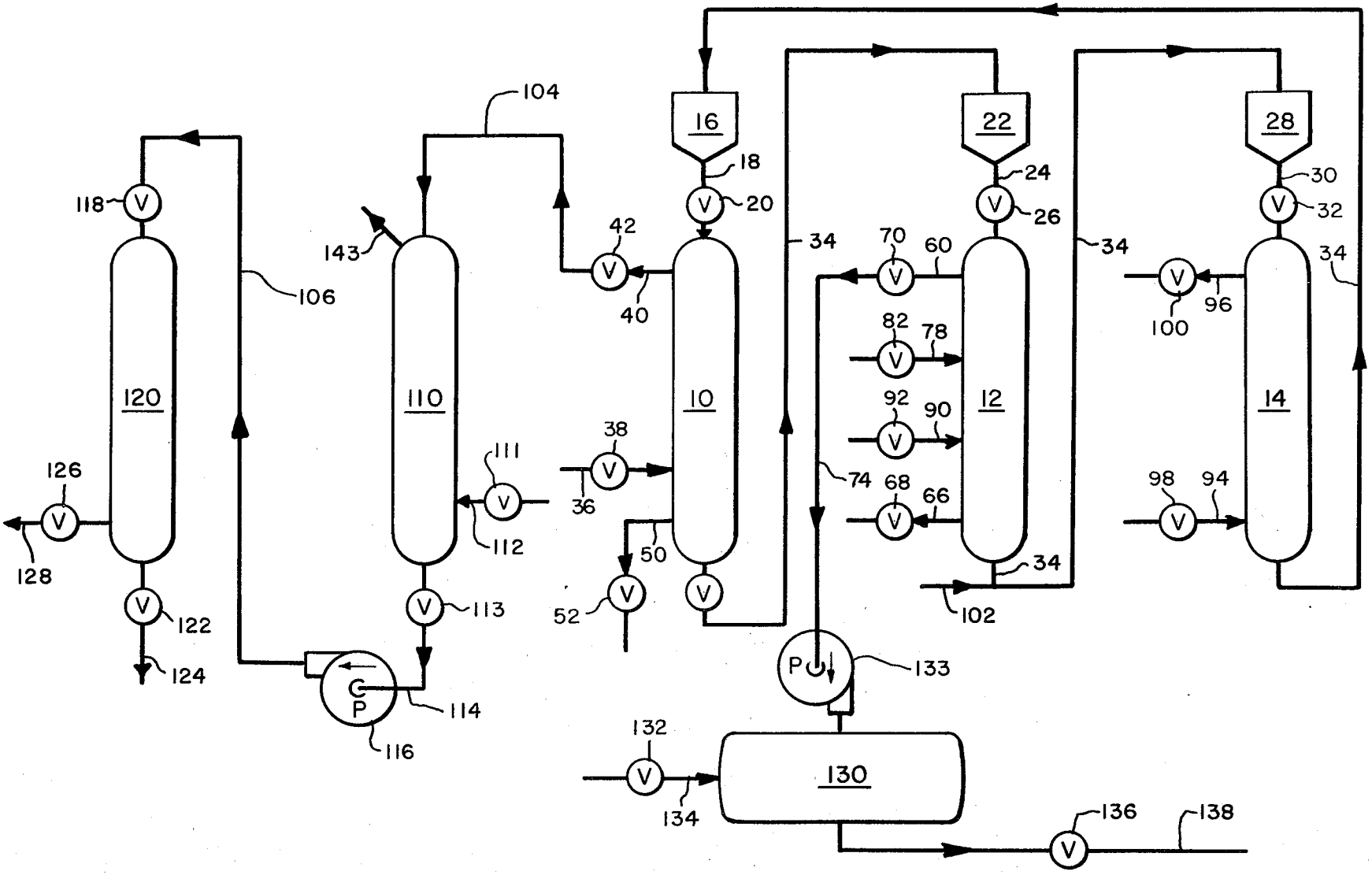
10
12
14
16
18
20
22
24
26
28
30
32
34
36
38
40
42
50
52
60
66
68
70
74
78
82
90
92
94
96
98
100
102
104
106
110
111
112
113
114
116
118
120
122
124
126
128
130
132
133
134
136
138
143
P

URANIUM RECOVERY FROM CARBONATE LEACH LIQUORS USING CARBOXYLIC ACID CATION EXCHANGE RESIN

This application is a continuation of application Ser. No. 190,992, filed Sept. 26, 1980, now abandoned.

BACKGROUND OF THE INVENTION

The present invention relates to a method and apparatus for recovery of uranium from carbonate solutions, such as leach liquors resulting from leaching of uranium deposits with a solution of sodium or ammonium carbonate or bicarbonate, or even carbon dioxide solutions to form carbonate solutions having a pH in the range of about 4.2 to about 9.8. A further embodiment of the present invention is directed toward restoring the liquid remaining after the uranium has been removed to a purified condition suitable, for instance, for return to the groundwater.

Much of the known uranium now existing in the world is in ores with uranium contents below 0.2% $U_3O_8$. One typical method to remove uranium from such low grade ores is to leach the ore, either above the ground or under the ground (in situ leaching), to produce a fairly low grade uranium leach liquor, and then to recover the uranium from the leach liquor. The end product is typically referred to as uranium yellow cake, which is usually sent to a refinery where it is further purified into a form suitable for enrichment and fuel fabrication.

The waste liquor following uranium recovery must be treated, particularly during in situ leaching operations. It must be restored to the original groundwater conditions prior to disposal. Recovery of uranium during such a restoration process is highly desirable.

Reverse osmosis, with or without a preceeding lime softening step, is one known technique for restoring such solutions. Residual uranium is not always recoverable through such a technique, because reverse osmosis is not selective; it also removes a large number of other dissolved solids from which the uranium must later be separated. Furthermore, the reverse osmosis membranes scale easily, and pretreatment of reverse osmosis influent feed with acid and polyphosphates is not always an efficient and inexpensive way to prevent scaling.

One of the most inexpensive acid leaching systems utilizes sulfuric acid, hydrochloric and nitric acid are effective though sometimes considered too expensive. Sulfuric acid leaching provides a leach liquor which contains many cations, some of which are divalent or trivalent. Some of these cations are $Fe^{+3}$, $Fe^{+2}$, $Al^{+3}$, $Mg^{+2}$, $Ca^{+2}$, $Mn^{+2}$, $Zn^{+2}$, $Na^{+}$, and $K^{+}$.

Typical prior art methods to recover uranium from such leach liquors include precipitation and anion exchange. Some of these methods are disclosed in two books by Robert Kunin, one of the inventors of the present invention: *Elements of Ion Exchange* (1971) at 102–109, and *Ion Exchange Resins* (1972) at pages 190–197.

These latter two prior art methods also present problems. For instance, direct precipitation of uranium from acid leach liquors with such compounds as ammonia is not preferred because the precipitate does not contain a significantly greater percentage of uranium than the original ore. Also, anion exchange processes adsorb, in addition to uranium anions, $HSO_4^{-}$, $SO_4^{-2}$, and a number of other anion sulfate complexes containing titanium, zirconium, vanadium, molybdenum, iron and thorium. Vanadium, iron, and molybdenum are often adsorbed in highly undesirable quantities. Prior art techniques to accommodate this unwanted adsorption of vanadium and molybdenum include selective elution, as discussed in U.S. Pat. No. 2,864,667 (Bailes et al.), adjusting the pH of the leach solution, as discussed in U.S. Pat. No. 2,841,468 (Wilson), and contacting a reduced pH eluate with activated carbon, as discussed in U.S. Pat. No. 4,092,399 (Narayan et al.). Such known techniques do not alter the fact that anion exchange resins often adsorb molybdenum and vanadium in highly undesirable quantities.

While it has been hypothesized that highly selective cation exchange resins might be able to work on uranium sulfate leach liquors (see Kunin, *Elements of Ion Exchange* 104 (1971)), the process generally used is an anion exchange process, as discussed in Merrit, *The Extractive Metallurgy of Uranium* 137–63 (1971). Cation exchange processes on the products of sulfuric, hydrochloric, or nitric acid leaching adsorb, along with the uranium, even more unwanted ions than anion exchange processes, such as calcium, magnesium, iron, aluminum and so forth. Liquid cation exchangers such as perfluorooctanoic acid and di-2-ethylhexylphosphoric acid (D2EHPA), while used in some uranium plants on acid leach liquors, typically have high solubility and a tendency to form emulsions. It is not believed that liquid cation exchangers have previously been used on carbonate leach liquors.

It should be noted at this point that, throughout the application herein, the term "adsorption" is used to refer both to processes or ion exchange which occur at surface of ion exchange resins and to those processes which occur throughout the entire resin structure. By using the term adsorption in this application, including the claims herein, applicants do not intend to limit the claims to processes or apparatus involving surface actions on ion exchange resins.

While the above-noted problems occur when prior art leaching methods with sulfuric, hydrochloric, or nitric acid are used, leaching with hydrochloric or nitric acid has particular drawbacks. Cation exchange techniques on chloride solutions using Amberlite IRC-50 are discussed in the U.S. Atomic Energy Commission Report RMO-2502 (now declassified) for July 1, 1951 through Aug. 1, 1951, and disadvantages with increased chloride concentration and the addition of calcium were reported. Furthermore, anion exchange does not efficiently remove uranium from hydrochloric or nitric acid leach liquors. In hydrochloric acid solutions the uranyl cation forms anionic complexes but these are much weaker complexes than those formed with the iron, zinc, and other cations that are present in the solution. Therefore, anion exchange will not be sufficiently selective on the hydrochloric leach liquor to efficiently remove uranium. Also, anion exchange will not remove uranium from nitric acid leach liquors because the uranyl cation, $UO_2^{+2}$, does not form anionic complexes with nitrates.

Sulfuric, hydrochloric or nitric acid leaching agents cannot be used economically with ores having a high limestone content. In such cases, leaching of the uranium can be achieved on the alkaline side with a solution of sodium or ammonium carbonate and/or bicarbonate, or even with carbon dioxide solutions. It is the product of that leaching process that the present invention is directed toward treating. For the purposes of this description and the claims herein, the phrase "carbonate solution" is used in a broad sense to include carbonate leach liquors having a pH of about 4.2 to about 9.8, which are produced by sodium or ammonium carbonate and/or bicarbonate or by a carbon dioxide solution, reacting with the alkaline ores being leached.

Such a carbonate solution probably contains complex carbonate ions, and it is believed that the ionic species are governed by the following equilibrium reaction although the underlying processes are not fully understood:

$$UO_2^{+2}+(CO_3^{-2})_n \rightleftarrows [UO_2(CO_3)_n]^{2-2n}$$

Probably the most common anoinic complex present is $$[UO_2(CO_3)_2]^{-2}$$

so that the uranyl carbonate anion complex is probably in equilibrium with the uranyl cation as follows:

$$UO_2^{+2}+2(CO_3^{-2}) \rightleftarrows [UO_2(C0_3)_2]^{-2}$$

According to prior art methods, such as disclosed in Kunin, *Ion Exchange Resins* (1972) at pages 195–97, the uranium can be recovered from the carbonate solution in several ways. First, alkali could be added to precipitate $Na_2U_2O_7$. the filtrate from this precipitaton would be recarbonated with carbon dioxide for reuse in leaching more ore. Second, the carbonate solution could be acidified with hydrochloric acid and boiled to remove carbon dioxide, with uranium precipitated as the hydroxide by adjusting the pH to neutrality. Last, it appears that anion exchange could operate on the anionic uranium complex to recover the uranium. Ion exchange recovery is particularly useful when the digested pulp presents difficult filtration problems. Since many carbonate ores contain bentonite clay, filtration is often difficult, leaving ion exchange on the unclarified pulp as the most attractive prior art method in such a situation.

Known prior art methods of recovering uranium from carbonate leach liquors utilized anion exchange, even though cation exchange was considered a possibility for treating chloride leach liquors, and a highly selective cation exchange resin might remove uranium from a sulfate leach liquor. Such anion exchange processes for removal of uranium from carbonate leach liquors are discussed in U.S. Pat. No. 4,155,982 (Hunkin et al.), U.S. Pat. No. 2,982,605 (Mouret et al.), U.S. Pat. No. 2,811,412 (Poirier), U.S. Pat. No. 2,780,514 (Lutz), and Merrit, *The Extractive Metallurgy of Uranium* 151–56 and 161–63 (1971). However, molybdenum and vanadium, often present in carbonate leach solutions, are also adsorbed in undesirable quantities by the anion exchange resin, as discussed above. Prior to the present invention, it was not considered feasible to use a cation exchange process on carbonate leach solutions containing uranium, because of the relatively high level of cations that would be separated from solution along with the uranium just as when cation exchange processes are used on sulfuric, hydrochloric or nitric acid leach solutions.

SUMMARY OF THE INVENTION

According to the present invention, and in contrast with the prior art used on carbonate leach solutions containing uranium ions, a cation exchange process is used. A carbonate solution containing uranium ions is caused to contact a weakly acidic cation exchanger whereby uranyl cations are removed. This removal of uranyl cations drives the aforementioned equilibrium equation to the left, thereby producing more uranyl cations for removal by cation exchange.

An added advantage of using a cation exchanger according to the present invention is the formation of more uranyl cations by removal of carbonate and bicarbonate ions through the cation exchange process. This further increases the concentration of uranium in the cation resin, and is demonstrated in the reaction set forth below:

$$2RCOOH+Na_2CO_3 \rightarrow 2RCOONa+CO_2+H_2O$$

$$2RCOOH+Ca(HCO_3)_2 \rightarrow (RCOO)_2Ca+2CO_2+2\text{-}H_2O$$

in which 2RCOOH represents a carboxylic acid cation exchange resin.

In summary, then, according to the present invention, there is provided a process for recovering uranium from a carbonate solution containing uranium ions comprising, first, causing the carbonate solution containing uranium ions to come in contact with a cation exchanger so that the uranium cation is removed from solution and adsorbed by the cation exchanger and second, removing the uranium cation from the cation exchanger. The preferred form of carboxylic acid cation exchanger is a cation exchange resin. The preferred method of removing the uranium cation from the cation exchange resin is by elution with a mineral acid such as hydrochloric acid. The uranium ion is then removed from the uranium solution by precipitation or contact with an anion exchange resin. According to a further embodiment of the process of the invention, carbon dioxide is removed from the treated carbonate solution produced by the cation exchange resin unit to leave a decarbonated solution, and the decarbonated solution is passed through a membrane to remove some of the remaining impurities. A suitable membrane process to restore the decarbonated, uranium-free solutions to acceptable environmental levels is either reverse osmosis or electrodialysis.

According to the apparatus of the invention, there is provided an apparatus for recovering uranium from a carbonate solution containing uranium ions comprising a cation exchange unit, a uranium precipitation vessel connected to the cation exchange unit, a decarbonator for receiving effluent from the cation exchange resin unit, and a membrane process unit for treating effluent from the decarbonator. In some instances the decarbonator or membrane unit could be eliminated. The preferred form of cation exchanger is a weakly acidic cation exchange resin in the hydrogen form.

The apparatus and method of the present invention for recovery of uranium from a carbonate and/or bicarbonate solution produces at least the following advantages and benefits. First, recovery of uranium by removal of cationic species produces an ideal feed for reverse osmosis apparatus. Calcium is removed and carbonate reduced. This is especially important when it is desirable to restore the treated carbonate solution (with uranium and other cations removed) to a low enough level of impurities for return to the groundwater. The reverse osmosis processes could then work primarily on the remaining impurities left in the treated carbonate solution without scaling or fouling of the membrane. Such an improved feed requires fewer chemical agents, including acid and anti-scalants.

Second, since the uranium is recovered as the alkalinity is removed, the overall salinity of the carbonate solution is reduced. It may be possible, through a recycle procedure, to reduce the effluent carbonate solution from a cation exchange process to acceptable levels of impurities for return to the groundwater, without reverse osmosis, electrodialysis, or other postion exchange treatment.

Third, since many carbonate leach solutions contain vanadium and molybdenum present as anions, the use of anion exchange resins for recovering uranium yields yellow cakes contaminated with objectionable quantities of vanadium and molybdenum. However, since the vanadium and molybdenum are present as very stable anions, the weakly acidic cation exchange resins of the preferred embodiment of the present invention cannot adsorb the molybdenum and vanadium, and therefore the apparatus and process of the present invention yield a very pure yellow cake uranium product free of objectionable vanadium and molybdenum.

Fourth, because of the unusual properties of the weakly acidic cation exchange resin, an acid eluate obtained during regeneration with acid, such as hydrochloric acid, can be recycled several times after refortification with acid before precipating the uranium. This procedure will yield a higher uranium eluate concentration, a higher waste concentration, and a lower waste volume, making for a more efficient recovery and an environmentally acceptable system.

Fifth, a weakly acidic cation exchange resin will also remove traces of radium in the influent carbonate leach solution, and also should remove barium which fouls reverse osmosis membranes.

Sixth, the apparatus and process of the present invention is a distinct advantage over lime softening and reverse osmosis processes typically used in the prior art to restore waste solutions from which uranium has been removed. Lime softening is disadvantageous because large quantities of chemicals are required and relatively large volumes of waste are produced. The present invention overcomes the disadvantages of lime softening and subsequent precipitate removal because the present invention yields a much purer yellow cake than through lime softening processes alone.

Other objects and advantages of the present invention will become apparent upon reading the following detailed description of the preferred embodiment in conjunction with the drawing, which illustrates generally, in schematic form, the apparatus of the present invention suitable for carrying out recovery of uranium from carbonate solutions by means of a cation exchange unit, a decarbonator, a membrane process, such as reverse osmosis or electrodialysis, and a uranium recovery vessel for removal of uranium by precipitation or ion exchange.

DETAILED DESCRIPTION OF THE PREFERRED EMBODIMENTS

Referring now to the drawing, the apparatus of the preferred embodiment of the present invention comprises a cation exchange unit, including a service tank 10, a regeneration tank 12, and a wash tank 14; a decarbonator 110; a membrane process unit 120; and a uranium recovery unit 130. The sizes of the tanks and other units on the drawing is not necessarily the relative size of the apparatus in practice, as their relative size is adapted to the capacities required for service, regeneration, washing, decarbonation, membrane process, and uranium precipitation.

The cation exchange unit can be of the fixed bed type or of the continuous countercurrent ion exchange type, such as disclosed in U.S. Pat. No. 3,595,784, assigned to the assignee herein, and incorporated herein by reference. The discussion herein of the cation exchange unit is adapted from the disclosure of that patent.

The ion exchange resin used herein is preferably a weakly acidic cation exchange resin. Although various weakly acidic cation exchangers such as the aluminosilicates (gels and molecular sieve zeolites) or liquid cation exchangers such as perflourooctanoic acid and di-2-ethylhexylphosphoric acid (D2EHPA) could be used by one of ordinary skill in the art, the preferred cation exchanger is a resin because inorganic zeolites would not be stable under the conditions of the uranium recovery process herein. The preferred forms of cation exchange resins are carboxylic acid resins, such as those based on methacrylic acid divinylbenzene (DVB) and hydrolyzed methyl or ethyl acrylate divinylbenzene (DVB) copolymers. Crosslinked copolymers based upon maleic and resorcylic acids could also be used, with acrylic polymers preferred.

Examples of suitable cationic resins in the methacrylic acid/DVB type are: Amberlite IRC-50 from Rohm and Haas Co., Ionac CC from Ionac Co., and Duolite C-464 from Diamond Shamrock Co. Suitable cationic resins in the hydrolyzed acrylate/DVB ester type are: Amberlite IRC-84 from Rohm and Haas Co., Ionac CNN from Ionac Co., Dowex CCR-2 from Dow Chemical Co., and Duolite C-433 from Diamond Shamrock Co. Also the ion exchange resin is preferably in bead form. Fluid beds or fixed beds of such resin may be used, as is known by those of ordinary skill.

The cation exchange apparatus will now be discussed in greater detail. According to the preferred embodiment, a regenerated resin reservoir 16 communicates with an upper portion of the service tank 10 through a resin conduit 18 having a transfer valve 20. Similarly, the regeneration tank 12 has an exhausted resin reservoir 22 communicating with an upper portion thereof through a resin conduit 24 having a transfer valve 26. Finally, the wash tank 14 has a metering reservoir 28 communicating with an upper portion thereof through a resin conduit 30 having a valve 32. As with the tanks 10, 12, and 14, the reservoirs 16, 22, and 28 will not necessarily be the same size. Resin transfer conduits 34 are connected to permit the transfer of resin from a lower portion of the service tank 10 to the exhausted resin reservoir 22, from a lower portion of the regeneration tank 12 to the metering reservoir 28, and from a lower portion of the wash tank 14 to the regenerated resin reservoir 16. Although the preferred embodiment shows three tanks 10, 12, and 14 for efficient service cycle operation, fewer tanks may be used.

Also, instead of using one service tank for cation exchange, more than one servive tank in series may be used as is known in the art. Such a dual service tank system may be desirable when the influent solution to the first service tank contains large amounts of nonuranium cations that would compete for adsorption on the cation exchange resin. Uranium that would leak from the first tank prior to saturation of the cation exchange resin in the first tank would be adsorbed in the second tank.

In operation, the carbonate solution containing uranium ions is delivered to the service tank 10 through a service inlet 36 having a service inlet valve 38, and the treated carbonate solution with a major portion of the uranium ions removed is withdrawn at a service outlet line 40 having a service outlet valve 42. A drain line 50 having a drain valve 52 communicates with the service tank 10 at a lower portion.

During operation, the service tank 10 is internally pressurized, and has a major portion of the resin compacted in an area above the level of the service inlet line 36. A void zone, containing liquid only, is formed between the service inlet line 36 and an area just above the bottom of the tank 10, where there is also some compacted resin. As it periodically becomes necessary to replace a portion of the exhausted resin in the service tank 10 with fresh resin from the regenerated resin reservoir 16, the service inlet valve 38 and service outlet valve 42 are closed, and the drain valve 52 is opened, depressurizing the tank 10. The transfer valve 20 is opened, and the bed of resin flows downwardly under the influence of gravity. Additional resin flows in from the regenerated resin reservoir 16 as a result of the opening of the transfer valve 20. After sufficient resin has entered the tank 10, the drain valve 52 and transfer valve 20 are closed, and the tank 10 is pressurized by again opening the service inlet valve 38 and the outlet valve 42. The repressurization compacts the bed, and again produces a void zone below the inlet line 36, forcing a portion of the exhausted resin through the transfer conduit 34 to the exhausted resin reservoir 22.

The regeneration tank 12 is the site of this elution of the uranium ions from the cation exchange resin to form a solution containing uranium ions at a greater concentration than that of the influent carbonate solution. The regeneration tank 12 has an upper liquid outlet line 60, a regenerant inlet line 78 below the outlet line 60, and preferably near the midpoint of the tank 12, and a separation liquid inlet line 90 communicating with the tank 12 below the regenerant inlet line 78 at a point above the bottom of the tank 12. Near the bottom of tank 12 and below the separation liquid inlet line 90 a drain line 66 having a drain valve 68 communicates with the tank 12. As shown in the drawing, the upper liquid outlet line 60 has an outlet valve 70 located thereon, and the separation liquid inlet line 90 has a valve 92 located thereon.

In the wash tank 14, final cleansing of the resin is preferably carried out on a fluidized bed principle. The wash tank 14 has a cleansing liquid inlet line 94 and a cleansing liquid outlet 96, each having valves designated respectively by reference numerals 98 and 100.

In operation, during the regeneration of resin and elution of uranium ions from the cation exchange resin, all valves on lines leading to the regeneration tank 12 are closed except for the outlet valve 70, the valve 82 on the regenerant inlet line 78, and the valve 92 on the separation liquid inlet line 90. In addition, the valve 32 on the resin conduit 30 below the metering reservoir 28 is closed. The separation liquid is delivered under sufficient pressure to maintain the resin in the tank 12 packed above the level of the separation liquid inlet line 90, so that a void zone, containing primarily liquid, is present below this inlet line 90. Some additional resin will also normally be present in the bottom of the tank 12. This resin is prevented from leaving the tank 12 since the metering reservoir 28, as well as the transfer conduit 34 between the metering reservoir 28 and the regeneration tank 12, are filled with a slurry of resin.

As the separation liquid, which will ordinarily be water, travels upwardly, it mixes with the regenerant being introduced at the regenerant inlet line 78. In the preferred embodiment of the present invention, the regenerant is a mineral acid, such as hydrochloric acid. Other suitable mineral acids are nitric acid and sulfuric acid. The mineral acid both regenerates the cation exchange resin and elutes the uranium, as $UO_2^{+2}$ or $[UO_2^{+2}(Cl_3)]^-$, when hydrochloric acid is used. Both the regenerant and separation liquid are withdrawn from the tank 12 at the upper liquid outlet line 60. Therefore, the upper liquid outlet line 60 contains a solution having a greater uranium ion concentration than that of the influent carbonate solution in the inlet line 36, making the uranium ion solution in the upper liquid outlet line 60 suitable for removal of the uranium by precipitation or anion exchange. The eluant can also be recycled through the regeneration tank 12, instead of eluting with fresh mineral acid, until the desired concentration of uranium ion in the eluant is obtained.

Below the separation liquid inlet line 90, there will be relatively little upward flow. The small amount of upward flow that does exist will be produced by liquid that enters the tank 12 from a pushwater pipe 102, which communicates with the resin transfer conduit 34 just below the regeneration tank 12. It is the function of this pushwater pipe 102 to aid in the transfer of resin between the regeneration tank 12 and the metering reservoir 28 as described herein.

Periodically, a portion of "slug" of regenerated resin is removed from the regeneration tank 12 and transferred to the metering reservoir 28. To initiate this cycle, the valves 70, 82, 92 on the outlet line 60, the regenerant inlet line 78, and the separation liquid inlet line 90 are closed, shutting off flow within the tank 12. The drain valve 68 and the transfer valve 26 are then opened, depressurizing the tank. Exhausted resin from the reservoir 22 flows into the tank 12 under the influence of gravity. At the same time, the valve 32 below the metering reservoir 28 is opened, allowing resin to flow from the metering reservoir 28 into the wash tank 14.

After the tank 12 has been nearly completely filled with loose resin, the repressurization step is initiated. The drain valve 68 and transfer valve 26 are closed, and the valves 70, 82, 92 on the outlet line 60, the inlet line 78, and the separation liquid inlet line 90 are again opened. The valve 32 below the metering reservoir 28 is closed, halting the flow of resin into the wash tank 14.

Washed resin from the wash tank 14 is transferred at various times through the transfer line 34 to the regenerated resin reservoir 16. Primary effluent streams from the cation exchange apparatus described above are thus the treated carbonate solution in service outlet line 40 (that is, with uranium and other cations removed) and the concentrated uranium ion solution in outlet line 60. In order to accomplish recovery of the uranium removed from the carbonate solution, the concentrated uranium ion solution is passed through line 74 and pumped by transfer pump 133 into the uranium recovery vessel 130.

In one form of the present invention, uranium is precipitated by adding the ammonium ion via $NH_3$ until a pH of 6.8 to 7.0 is reached. As discussed in Kunin, *Elements of Ion Exchange* (1971) at pages 108–09, the precipitation can also be accomplished by adding either NaOH or MgO. The precipitate may be thought of as diuranate, $Na_2U_2O_7.xH_2O$, although some $UO_3.xH_2O$ is also present. The precipitated uranium is then filtered, dried or calcined, and is then shipped as "yellow cake" feed material for uranium refineries.

Alternatively, the hydrochloric acid eluate containing the uranium may be further concentrated and purified by passage through any of a number of anion exchange resins, strongly and weakly basic, such as Amberlite IRA-400 from Rohm and Haas Co., Dowex 21K from Dow Chemical Co., and Amberlite IRA-93 from Rohm and Haas Co. The uranium is then eluted from the anion exchange resin with water to form a solution from which the uranium may be precipitated with an alkaline reagent, such as ammonia or sodium hydroxide, or with hydrogen peroxide.

The treated carbonate solution contains other ions, as noted above, such as vanadium, molybdenum, as well as residual amounts of sodium and magnesium. If it is necessary or desirable in the uranium leaching system to restore the treated carbonate solution to acceptable original groundwater levels, then additional filtration and treatment may be required. According to the preferred embodiment of the present invention, this treatment is accomplished in a decarbonator unit 110 and a membrane process unit 120. When the outlet valve 42 is open, treated carbonate solution passes into the decarbonator unit 110 through transfer line 104, where under a process as known in the art, $CO_2$ is released. One such suitable decarbonator is disclosed in U.S. Pat. No. 2,807,582 (Applebaum). Suitable gas influent can be added through the conduit 112 by opening the valve 111 to release $CO_2$ from solution. The $CO_2$ is vented through the vent 143.

The effluent of the decarbonator 110 is then transferred through the transfer line 106 to the membrane process unit 120 to remove remaining ions, by opening valves 113 and 118 and operating pump 116. As is known in the art, the membrane process unit can be operated at a rate sufficient to accomplish desired removal of remaining salts, and other cations and anions generally. The membrane process unit 120 may be a reverse osmosis unit, or may be an electrodialysis unit. The preferred form is a reverse osmosis unit, containing a known semipermeable membrane. Other suitable membrane processes will be apparent to those of ordinary skill. The effluent from the membrane process unit 120 then consists of two forms, released selectively by valves 126 and 122, respectively, when valve 118 is opened. These effluents are purified water in outlet line 128, suitable for return to the groundwater, and a waste stream in outlet line 124 for disposal.

Of course, it should be understood that modifications and changes to the preferred embodiments disclosed herein may be apparent to those of ordinary skill in the art without departing from the spirit and scope of the present invention, and without diminishing its attendant advantages. It is therefore intended that all such modifications and changes be covered by the following claims.

We claim:

1. A process for quantitatively recovering uranium from a carbonate solution including uranium ions, said carbonate solution having a pH in the range of from about 4.2 to about 9.8, the process comprising:

causing the carbonate solution including uranium ions to come in contact with a carboxylic acid cation exchange resin so that uranium cations are removed from solution and adsorbed by said resin; and removing the uranium cations from the cation exchange resin.

2. The uranium recovery process of claim 1 wherein uranium cations are removed from the carboxylic acid cation exchange resin by elution with hydrochloric acid.

3. The process of claim 1 wherein said carboxylic acid cation exchange resin is methacrylic acid divinylbenzene copolymer or hydrolyzed methyl acrylate divinylbenzene copolymer or hydrolyzed ethyl acrylate divinylbenzene copolymer.

4. The process of claim 1 wherein said carboxylic acid cation exchange resin is selected from the group consisting essentially of methacrylic acid divinylbenzene copolymer, hydrolyzed methyl acrylate divinylbenzene copolymer, and hydrolyzed ethyl acrylate divinylbenzene copolymer.

5. A process for recovering uranium from a carbonate solution including uranium ions, the process comprising:

causing the carbonate solution including uranium ions to come in contact with a carboxylic acid cation exchange resin so that uranium cations are removed from solution and adsorbed into the cation exchange resin;

eluting the uranium cations from the cation exchange resin to produce a uranium ion solution; and removing said uranium cations from the uranium solution.

6. The uranium recovery process of claim 5 wherein the step of removing uranium ions from solution is accomplished by adding ammonium ions to the uranium ion solution so that a uranium precipitate is formed.

7. A process for recovering uranium from a carbonate solution including uranium ions, said carbonate solution having a pH in the range of from about 4.2 to about 9.8, which process comprises:

contacting the carbonate solution including uranium ions with a weakly acidic carboxylic acid cation exchange resin to remove uranium cations from solution and to adsorb the uranium cations into said carboxylic acid cation exchange resin, and to produce a treated carbonate solution;

eluting the uranium cations from said carboxylic acid cation exchange resin with hydrochloric acid to produce a uranium cation solution;

selectively precipitating said uranium cations from solution with ammonium ions;

decarbonating said treated carbonate solution; and filtering said decarbonated solution to remove remaining impurities.

8. A process for recovering uranium from a basic carbonate solution including uranium ions, the process comprising:

causing the carbonate solution including uranium ions to come in contact with a weakly acidic carboxylic acid cation exchange resin so that uranium cations are removed from solution and adsorbed into the cation exchange resin, and a treated carbonate solution is produced;

eluting the uranium cations from the cation exchange resin to produce a uranium ion solution;

removing uranium ions from solution by selective precipitation; and removing carbon dioxide from the treated carbonate solution to produce a decarbonated solution.

9. The uranium recovery process of claim 8 further including the step of filtering the decarbonated solution through a membrane process.

10. The uranium recovery process of claim 9 wherein the membrane process is reverse osmosis.

11. The uranium recovery process of claim 9 wherein the membrane process is electrodialysis.

12. A process for recovering uranium from a carbonate solution including uranium ions, said carbonate solution having a pH in the range of from about 4.2 to about 9.8, which process comprises:

contacting the carbonate solution including uranium ions with a weakly acidic carboxylic acid cation exchange resin selected from the group consisting of methacrylic acid divinylbenzene copolymer, hydrolyzed methyl acrylate divinylbenzene copolymer, and hydrolyzed ethyl acrylate divinylbenzene copolymer to remove uranium cations from solution and to adsorb the uranium cations into said carboxylic acid cation exchange resin, and to produce a treated carbonate solution;

eluting the uranium cations from said carboxylic acid cation exchange resin with hydrochloric acid to produce a uranium cation solution;

selectively precipitating said uranium cations from solution with ammonium ions;

decarbonating said treated carbonate solution; and filtering said decarbonated solution to remove remaining impurities.

* * * * *